US011459154B2

(12) United States Patent
Johnson

(10) Patent No.: US 11,459,154 B2
(45) Date of Patent: Oct. 4, 2022

(54) SYSTEM FOR PREVENTING BLOCKAGE OF EVACUATION OF FLEXIBLE PACKAGING

(71) Applicant: Liqui-Box Corporation, Richmond, VA (US)

(72) Inventor: James W. Johnson, Delaware, OH (US)

(73) Assignee: LIQUI-BOX CORP., Richmond, VA (US)

( * ) Notice: Subject to any disclaimer, the term of this patent is extended or adjusted under 35 U.S.C. 154(b) by 0 days.

(21) Appl. No.: 17/224,299

(22) Filed: Apr. 7, 2021

(65) Prior Publication Data

US 2021/0316925 A1 Oct. 14, 2021

Related U.S. Application Data

(60) Provisional application No. 63/010,165, filed on Apr. 15, 2020, provisional application No. 63/006,788, filed on Apr. 8, 2020, provisional application No. 63/006,791, filed on Apr. 8, 2020.

(51) Int. Cl.
*B65D 75/58* (2006.01)
*B67D 1/08* (2006.01)

(52) U.S. Cl.
CPC ..... *B65D 75/5861* (2013.01); *B67D 1/0807* (2013.01); *B67D 2001/0827* (2013.01)

(58) Field of Classification Search
CPC ..... B65D 75/5861; B65D 75/5877; B67D 1/0807; B67D 2001/0827
See application file for complete search history.

(56) References Cited

U.S. PATENT DOCUMENTS 4,314,768 A * 2/1982 Goglio ..... B67D 1/1231 222/413
4,421,146 A 12/1983 Bond et al.
4,445,551 A 5/1984 Bond et al.
5,031,662 A 7/1991 Roethel
5,095,962 A 3/1992 Lloyd-Davies et al.
(Continued)

FOREIGN PATENT DOCUMENTS

JP 2015 0123996 A 7/2015
WO 01/36276 A2 5/2001
WO 2004085283 10/2004

OTHER PUBLICATIONS

PCT, Invitation to Pay Fees And, Where Applicable, Protest Fee, in Application No. PCT/US2021/026122, dated Jul. 5, 2021 (10 pages).

*Primary Examiner* — Donnell A Long
(74) *Attorney, Agent, or Firm* — McAndrews, Held & Malloy, Ltd.

(57) ABSTRACT

The present application relates to a system for evacuating fluid from a flexible container. The system includes a spout connected to a flexible container. A passageway within the spout is in fluid communication with an inside of the flexible container, and the passageway has a top end and a bottom end. An evacuation facilitating structure is positioned proximate the bottom end of the passageway and has a fluid channel therethrough. The evacuation facilitating structure blocks portions of the wall of the flexible container from entering the bottom end of the passageway and preventing fluid from evacuating the container via the passageway.

3 Claims, 18 Drawing Sheets

(56) References Cited

U.S. PATENT DOCUMENTS

| | | | | |
|---|---|---|---|---|
| 5,433,345 | A * | 7/1995 | Sasaki | B65D 5/606 222/105 |
| 5,680,970 | A | 10/1997 | Smith et al. | |
| 5,697,410 | A | 12/1997 | Rutter et al. | |
| 5,901,761 | A | 5/1999 | Rutter et al. | |
| 5,983,964 | A | 11/1999 | Zielinksi et al. | |
| 6,347,785 | B1 | 2/2002 | Copp et al. | |
| 6,779,556 | B2 | 8/2004 | Roethel | |
| 6,984,278 | B2 | 1/2006 | Anderson et al. | |
| 7,757,907 | B2 | 7/2010 | Smith et al. | |
| 8,517,061 | B2 | 8/2013 | Johnson | |
| 8,578,979 | B2 | 11/2013 | Johnson | |
| 2002/0148857 | A1* | 10/2002 | Savage | B65D 75/5877 222/107 |
| 2005/0139565 | A1* | 6/2005 | Cohn | A61J 11/002 215/11.1 |
| 2007/0053617 | A1 | 3/2007 | Naidu | |
| 2012/0061394 | A1* | 3/2012 | Pritchard | B65D 75/5877 220/277 |
| 2014/0339270 | A1 | 11/2014 | Johnson | |
| 2018/0008086 | A1* | 1/2018 | Dubief | B65B 1/06 |

* cited by examiner

SYSTEM FOR PREVENTING BLOCKAGE OF EVACUATION OF FLEXIBLE PACKAGING

CROSS-REFERENCE TO RELATED APPLICATIONS

This patent application claims priority to and the benefit of U.S. Provisional Patent Application Ser. No. 63/010,165, filed on Apr. 15, 2020, U.S. Provisional Patent Application Ser. No. 63/006,788, filed on Apr. 8, 2020, and U.S. Provisional Patent Application Ser. No. 63/006,791, filed on Apr. 8, 2020. U.S. Provisional Patent Application Ser. Nos. 63/010,165, 63/006,788, and 63/006,791 are incorporated herein by reference in their entireties.

BACKGROUND

Generally, this application relates to systems and methods for facilitating evacuation of fluids from flexible, collapsible polymeric packaging, and in particular, for preventing the blocking of evacuation of fluid from such packaging at the spout.

Flexible, collapsible plastic bags are often used to store fluid products such as soft drink syrups, fruit juices, and flowable foods, among other things. Such bags can also be used to store non-edible fluid products such as chemicals. The plastic bags are typically housed in a corrugated paperboard box to aid in the transporting, handling, and dispensing of the product. Such packaging systems are commonly referred to as "bag-in-box" packaging systems and are often used in restaurants and convenience stores to facilitate service of liquid food products.

The plastic bags in the bag-in-box systems typically have sidewalls sealed along a peripheral seam to define a fluid-containing chamber or pouch. The sidewalls are typically made of polymeric films with either a monolayer or multiple layer structure. The particular polymers constituting the container film layers vary depending on the type of fluid product to be placed in the container. A spout or a fitment is connected to the bag and provides access to the fluid chamber for filling the bag with product and dispensing the product from the bag. After the flexible container is filled with a desired product, the spout is capped to seal the flexible container and protect the contents from contamination. Depending on the type of contents, the container, spout, cap, and contents may be heat sterilized using steam, an autoclave process, or similar method.

To access and dispense the fluid contents of the flexible container, the flexible container must be evacuated, generally using a vacuum or suction process. Initially all of the air within the flexible container is evacuated. Subsequently, the fluid in the bag is evacuated. Sometimes, during the evacuation of the fluid, due to the suction force on the flexible container, the walls of the flexible container become lodged in the spout. This blocks up the spout and cuts off the passageway for the fluid. Thus, the evacuation process is essentially stopped, rendering the fluid inaccessible.

SUMMARY

Certain embodiments of the present technology relate to evacuation structures that facilitate evacuation of fluid from a flexible, collapsible container by preventing portions of the container wall from getting lodged in, or blocking or impeding the flow of fluid out of, the spout connected to the container.

Certain embodiments of the present application relate to a spout connected in fluid communication to a flexible container. A passageway within the spout is in fluid communication with an inside of the flexible container, and the passageway has a top end and a bottom end. An evacuation facilitating structure is positioned proximate the bottom end of the passageway and has a fluid channel therethrough. The evacuation facilitating structure blocks a portion of one of the walls of the flexible container from entering the bottom end of the passageway and preventing fluid from evacuating the container via the passageway.

Certain embodiments of the present technology relate to a system for evacuating fluid from a flexible container. The system includes a spout having a base that is configured to be connected to one of a plurality of walls of the flexible container and a passageway in fluid communication with an interior region of the flexible container, the passageway having an outlet at a top end and an inlet at a bottom end. The system includes a cage positioned proximate the bottom end of the passageway and including a circular rim that is mounted along the base of the spout proximate the inlet, the cage being positioned to block a portion of one of the plurality of walls of the flexible container from entering the inlet of the passageway and preventing fluid from evacuating the container via the passageway The cage may arc downward below the base of the spout and may be detachably connected to the spout. The cage may be detachably connected to the base via a bayonet connecting arrangement. The cage may include a plurality of intersecting bars that define a plurality of gaps through which fluid can flow into the spout.

Certain embodiments of the present technology relate to a system for evacuating fluid from a flexible container. The system includes a spout having a base that is configured to be connected to one of a plurality of walls of the flexible container and a passageway in fluid communication with an interior region of the flexible container, the passageway having an outlet at a top end and an inlet at a bottom end. The system includes a plurality of legs that extend downward from the base of the spout and that are positioned to block a portion of one of the plurality of walls of the flexible container from entering the inlet of the passageway and preventing fluid from evacuating the container via the passageway while allowing fluid to pass between the plurality of legs.

The system may include at least one bridge that extends between at least two of the plurality of legs. The bridge may define at least one gap through which fluid can flow into the spout. The system may include a connector that is slidably received in the passageway and that includes a bottom portion that extends below the base of the spout. The connector may include at least one cutout along the bottom portion that allows fluid to flow into the spout. The connector may include at least one slot along the bottom portion that allows fluid to flow into the spout. The connector may be movable within the passageway between a first position and second position, wherein when the connector is in the first position, the bottom portion of the connector does not extend below the base of the spout and when the connector is in the second position, the bottom portion of the connector extends below the base of the spout.

Certain embodiments of the present technology relate to a system for evacuating fluid from a flexible container. The system includes a spout having a base that is configured to be connected to one of a plurality of walls of the flexible container and a passageway in fluid communication with an interior region of the flexible container, the passageway having an outlet at a top end and an inlet at a bottom end. The system includes an insertable member that is slidably received in the passageway and that can be moved within the passageway between a first position and second position. When the insertable member is in the first position, a bottom portion of the insertable member does not extend below the base of the spout, and when the insertable member is in the second position, the bottom portion of the insertable member extends below the base of the spout and is positioned to block a portion of one of the plurality of walls of the flexible container from entering the inlet of the passageway and preventing fluid from evacuating the container via the passageway.

The insertable member may include a second passageway that extends therethrough through fluid can flow. The insertable member may include at least one cutout along the bottom portion that allows fluid to flow into the spout and the second passageway when the insertable member is in the second position. The insertable member may include at least one slot along the bottom portion that allows fluid to flow into the spout and the second passageway when the insertable member is in the second position. The insertable member may include a cage at the bottom thereof that defines gaps that allows fluid to flow into the spout and the second passageway when the insertable member is in the second position.

Certain embodiments of the present technology relate to a system for evacuating fluid from a flexible container. The system includes a spout having a base that is configured to be connected to one of a plurality of walls of the flexible container and a passageway in fluid communication with an interior region of the flexible container, the passageway having an outlet at a top end and an inlet at a bottom end. The system includes a flexible cage positioned proximate the bottom end of the passageway. The flexible cage includes an outer portion, an inner portion, and flexible arms. The outer portion is secured to the base of the spout. The inner portion including a top surface, a bottom surface, and a central bore that extends between the top and the bottom surface. The top surface includes a plurality of top protrusions with top gaps between the top protrusions. The bottom surface includes a plurality of bottom protrusions with bottom gaps between the bottom protrusions. The flexible arms connect the inner portion with the outer portion. The flexible cage has a first position where the flexible arms are deflected and the bottom protrusions extend a first distance below the spout base. In the first position, the bottom protrusions block a portion of one of the walls of the flexible container from entering the bottom end of the passageway and preventing fluid from evacuating the container via the passageway. The flexible cage has a second position where the flexible arms are not deflected and the bottom protrusions are closer to the spout base than they are when the cage is in the first position. The outer portion of the flexible cage may also include a plurality of outer protrusions with a plurality of gaps between the outer protrusions. The outer protrusions may extend below the spout base.

The system may also include an evacuation member. The evacuation member may include a head and a body. The head may insert into the central bore of the flexible cage's inner member. The body may extend into the container. The head and body may form a duct from within the container to the flexible cage.

Figure 1:
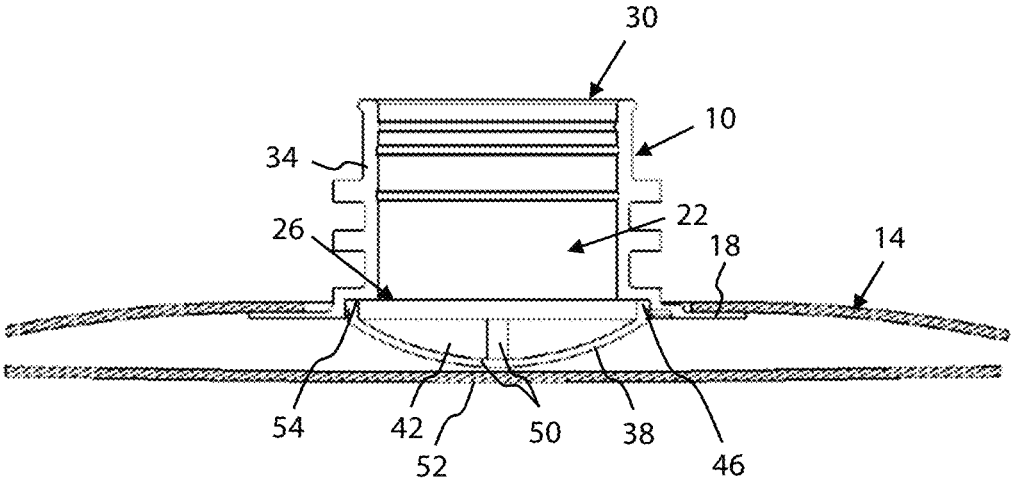
FIG. 1 illustrates is a cutaway side view of a spout and a container according to an embodiment of the present technology.
Figure 2:
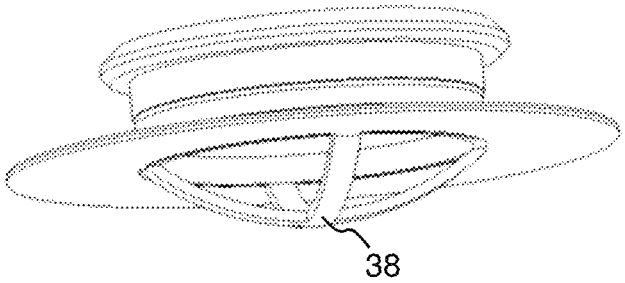
FIG. 2 illustrates a side isometric view of the spout of FIG. 1.
Figure 3:
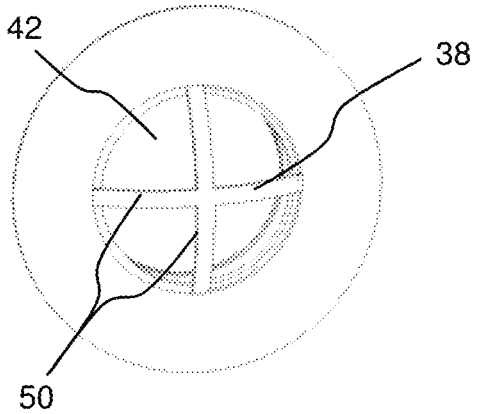
FIG. 3 illustrates a bottom isometric view of the spout of FIG. 1.
Figure 4:
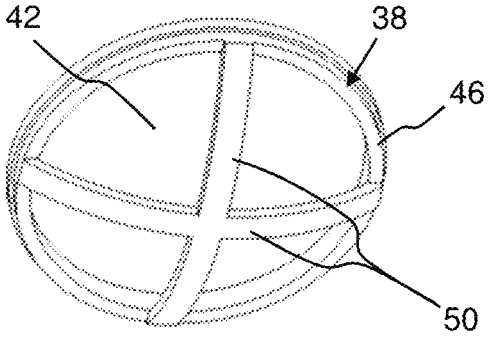
FIG. 4 illustrates a bottom isometric view of a cage used with the spout of FIG. 1.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIG. 1 illustrates a cutaway side view of a spout or fitment 10 in fluid communication with a flexible container 14 according to an embodiment of the present technology. The spout 10 and container 14 are both made of polymeric materials. The spout 10 is connected to the container 14 by, by way of example, heat sealing. The spout 10 may be attached near the bottom of the container but may also be attached at any number of other locations on the container 14. The spout 10 includes a base 18 and a passageway 22 extending between an inlet 26 at a bottom end of the spout 10 and an outlet 30 at a top end of the spout 10. The passageway 22 is defined by a cylindrical wall 34 that extends upwardly from the base 18.

The spout 10 provides fluid access to the contents of the container 14, which can be a flexible, collapsible bag or pouch. Typically, the container 14 is used for housing fluids such as, for example, soft drink syrups, which are withdrawn from the container 14 under pressure with a hose or other kind of conduit and mixed at a fountain with a diluent such as soda water. The hose (not shown) has a dispenser attachment for connecting to the spout 10 in a fluid and air-tight arrangement. A vacuum pressure is applied to the spout 10 through the hose to withdraw fluid under pressure from the container 14. The container 14 can be used to store any number of other types of fluids besides syrups.

With reference to FIGS. 1-4, an arced circular cage or grill 38 is detachably connected to the spout 10. The cage 38 includes four gaps 42. The cage 38 includes a circular rim 46 that can be mounted in or along the base 18 of the spout 10 proximate the inlet 26. The cage 38 includes a pair of arced bars 50 that extend inward from the rim 46 and that intersect each other and define the gaps 42. The sizes and shapes of the gaps 42 and bars 50 can vary from those shown in FIGS. 1-4. The arced bars 50 extend below the base 18 of the spout 10. The cage 38 is made of, by way of example, plastic and can be detachable from the spout 10. By way of example, the cage 38 can be press fitted in or snapably connected to an annular ledge or groove 54 located in or near the base 18 or inlet 26 of the spout 10. The cage 38 can be more rigid or more flexible depending on the properties of the fluid that is in the container 14 and the amount of suction needed to evacuate the fluid.

With reference to FIG. 1, initially the flexible container or bag 14 is filled with fluid through the outlet 30 of the spout 10. The spout 10 is then capped (not shown) to seal the flexible container 14 and fluid protect the contents from contamination. When it is time for the end user to empty the container 14, a dispensing connector (not shown) that is connected to a hose is connected to the spout 10. The hose is connected to a pump or vacuum device (not shown) that is used to suck the fluid out of the container 14. As fluid is sucked out of the container 14 and through the spout 10, a vacuum is created in the flexible container 14, and the container 14 collapses. The bars 50 of the cage 38 extending below the base 18 of the spout 10 help prevent the flexible walls 52 of the collapsing container 14 from becoming lodged in, or blocking, the inlet 26 of the spout 10 or entering the passageway 22 of the spout 10. At the same time, the gaps 42 of the cage 38 allow fluid to pass through the inlet 26 into the spout 10. In this way, the cage 38 helps prevent blockage by the flexible walls 52 while at the same time allowing fluid to evacuate through the cage 38 and spout 10. In alternative embodiments, the cage 38 of FIGS. 1-4 may be "flat"—and not arced—like the cage 126 of FIGS. 25-28.

Figure 5:
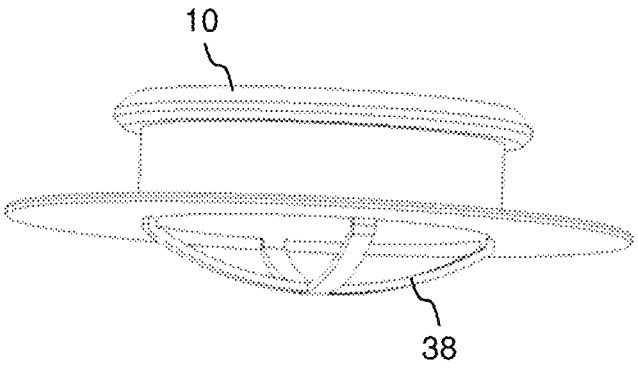
FIG. 5 illustrates a side isometric view of a spout according to an embodiment of the present technology.
Figure 6:
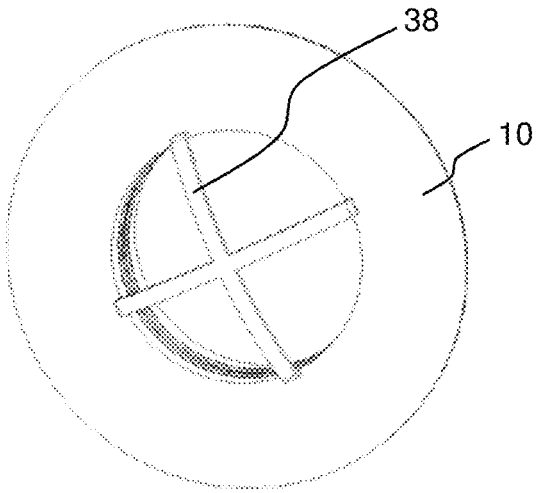
FIG. 6 illustrates a bottom isometric view of the spout of FIG. 5.

FIGS. 5-6 illustrate an alternative embodiment of the present technology. The embodiment includes a spout 10 and an arced circular cage or grill 38. The cage 38 and spout 10 are similar to those shown in FIGS. 1-4 except that the cage 38 is integrally formed with the spout 10 and is not detachable from the spout 10. The cage 38 operates to help prevent blockage in the same way the cage 38 shown in FIGS. 1-4 does.

Figure 7:
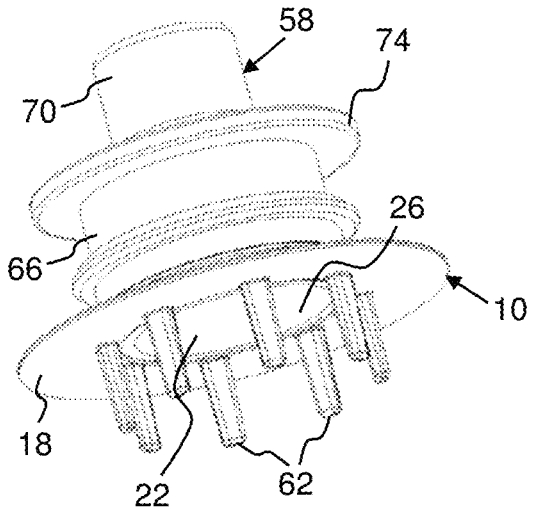
FIG. 7 illustrates a side isometric view of a spout and dispensing member in a first position according to an embodiment of the present technology.
Figure 8:
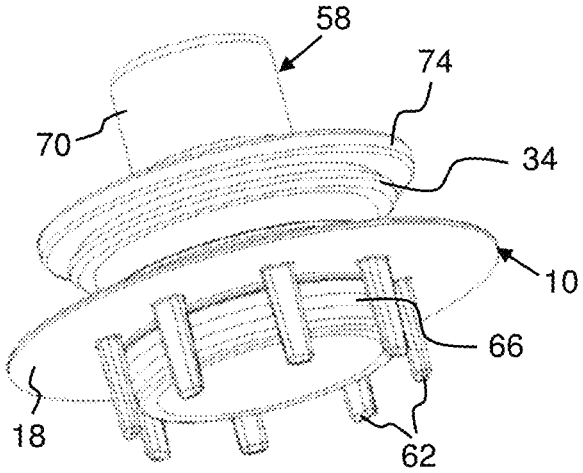
FIG. 8 illustrates a side isometric view of the spout and dispensing member of FIG. 7 in a second position.

FIGS. 7 and 8 illustrate an alternative embodiment of the present technology. The system includes a spout 10 and an insertable dispensing member 58. The spout 10 and dispensing member 58 can be used with the container 14 shown in FIG. 1 or similar other kind of flexible container. Extending from underneath the base 18 of the spout 10 and around the inlet 26 are a number of prongs or legs 62. By way of example, the spout 10 includes eight legs 62, but the spout 10 may include any number of legs 62. Moreover, the legs 62 may have different sizes, shapes, heights, and/or widths than those shown in FIGS. 7 and 8. Furthermore, the legs 62 may extend from different locations along the bottom of the base 18 than as shown in FIGS. 7 and 8. In operation, and as with the spout 10 shown in FIG. 1, the flexible container or bag 14 is filled—with the dispensing member 58 removed—with fluid through the outlet 30 of the spout 10 of FIGS. 7 and 8. The spout 10 is then capped (not shown) to seal the flexible container 14 and protect the contents from contamination. When it is time for an end user to evacuate the fluid from the container 14, the cap is removed and a dispensing member 58 is inserted into the passageway 22 of the spout 10.

FIG. 7 shows the dispensing member 58 in a "transit" or first position as it is being inserted into the spout 10, and FIG. 8 shows the dispensing member 58 fully inserted into the spout 10 to a "home" or second position. The dispensing member 58 includes a first cylindrical body 66 and a second cylindrical body 70. The first cylindrical body 66 has a greater diameter than the second cylindrical body 70, and the two bodies 66 and 70 are connected to opposite sides of a flange 74. As shown in FIG. 7, a portion of the first cylindrical body 66 is inserted into the passageway 22 of the spout 10. The second cylindrical body 70 of the dispensing member 58 may be connected via a tube or line to a pump or vacuum device (not shown) that is used to suck the fluid out of the container 14. With reference to FIG. 8, the dispensing member 58 can be pushed into the spout 10 until the flange 74 is resistibly engaged by the wall 34 of the spout 10, i.e., the "home" position. When the dispensing member 58 is in home position, a portion of the first cylindrical body 66 of the dispensing member 58 extends below the base 18 of the spout 10 and is encircled by the legs 62.

As fluid is sucked out of the container 14 and through the spout 10 and a fluid passageway in the dispensing member 58 by the pump, the legs 62 and/or the portion of the first cylindrical body 66 of the dispensing member 58 extending below the base 18 of the spout 10 help prevent the flexible walls 52 of the collapsing container 14 from becoming lodged in, or blocking, the inlet 26 of the spout 10 or entering the passageway 22 of the spout 10. In this way, the legs 62 and dispensing member 58 help facilitate evacuation of fluid from the container 14 and prevent blockage at the spout 10 during evacuation. Alternatively, the spout 10 of FIGS. 7-8 could be used without the dispensing member 58 such that the legs 62 of the spout 10 serve to prevent blockage of the spout inlet 26 and passageway 22. Or, alternatively, the spout 10 may not include the legs 62, and the dispensing member 58 can be used with the spout 10 such that the first cylindrical body 66 of the dispensing member 58 serves to prevent blockage of the spout inlet 26 and passageway 22.

Figure 9:
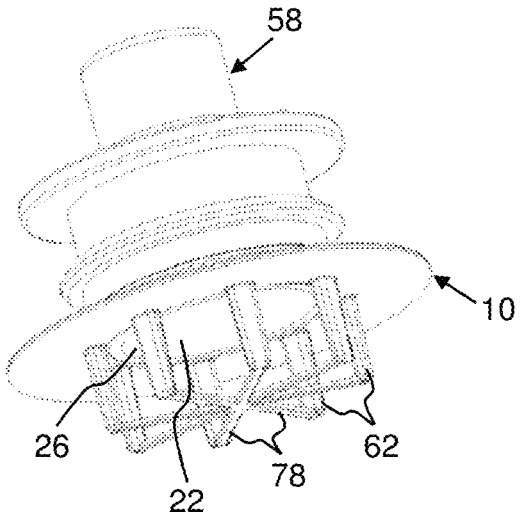
FIG. 9 illustrates a side isometric view of a spout and dispensing member in a first position according to an embodiment of the present technology.
Figure 10:
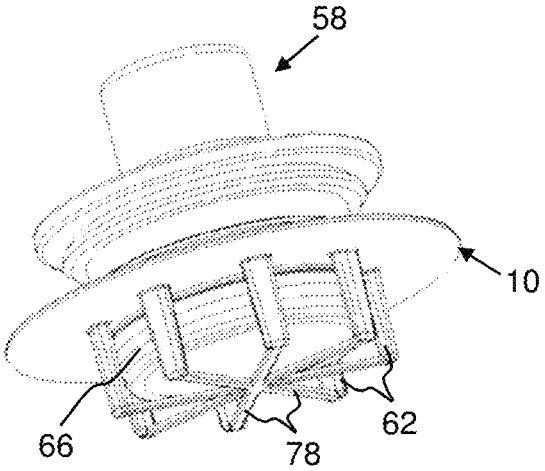
FIG. 10 illustrates a side isometric view of the spout and dispensing member of FIG. 9 in a second position.
Figure 11:
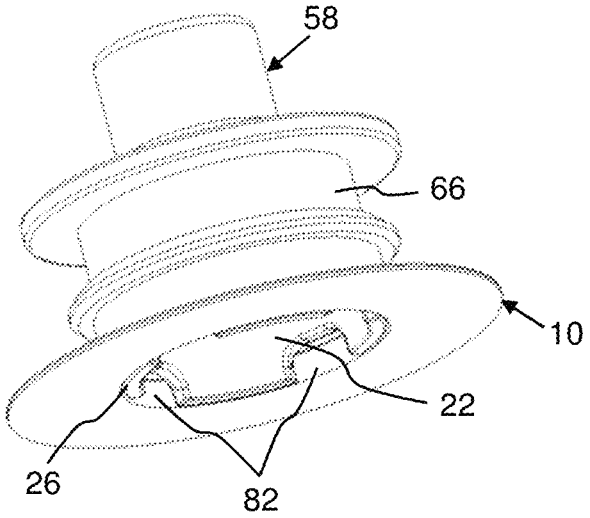
FIG. 11 illustrates a side isometric view of a spout and dispensing member in a first position according to an embodiment of the present technology.
Figure 12:
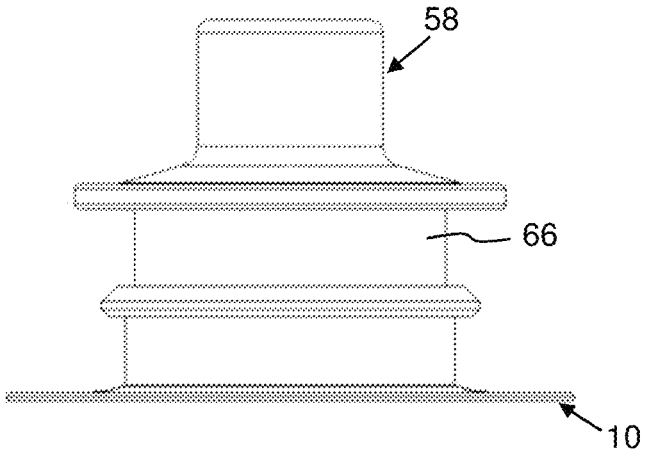
FIG. 12 illustrates a side view of the spout and dispensing member of FIG. 11.

FIGS. 9 and 10 illustrate an alternative embodiment of the present technology. The dispensing member 58 is the same as the one shown in FIGS. 7-8, and the spout 10 is similar to the one shown in FIGS. 7-8. The spout 10 in FIGS. 9 and 10 differs in that it includes bridges or bars 78 extending between pairs of oppositely aligned legs 62. The bridges 78 intersect around the center point between all the legs 62. The bridges 78 are thin and flexible and are generally perpendicular to the legs 62 they connect. The bridges 50, however, may include sizes, shapes, and/or thicknesses that differ from those shown in FIGS. 9 and 10. The bridges 78 also may extend from the legs 62 at different angles than those shown in FIGS. 9 and 10 or may be arced. Furthermore, while there are four intersecting bridges 78 shown in FIGS. 9 and 10, it will be appreciated that more or fewer bridges 78 may be used, depending on the number and orientation of the legs 62, among other things. In operation, the bridges 78 help, along with the legs 62 and the first cylindrical body 66 of the dispensing member 58, to prevent the flexible walls of the container 14 from blocking the spout inlet 26 and passageway 22 during evacuation. Alternatively, the spout 10 of FIGS. 9 and 10 could be used without the dispensing member 58 such that the legs 62 and bridges 78 serve to prevent blockage of the spout inlet 26 and passageway 22.

Figure 13:
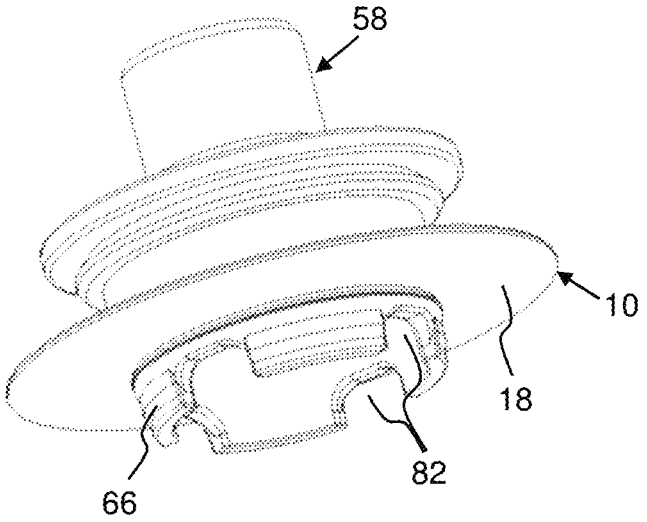
FIG. 13 illustrates a side isometric view of the spout and dispensing member of FIG. 11 in a second position.
Figure 14:
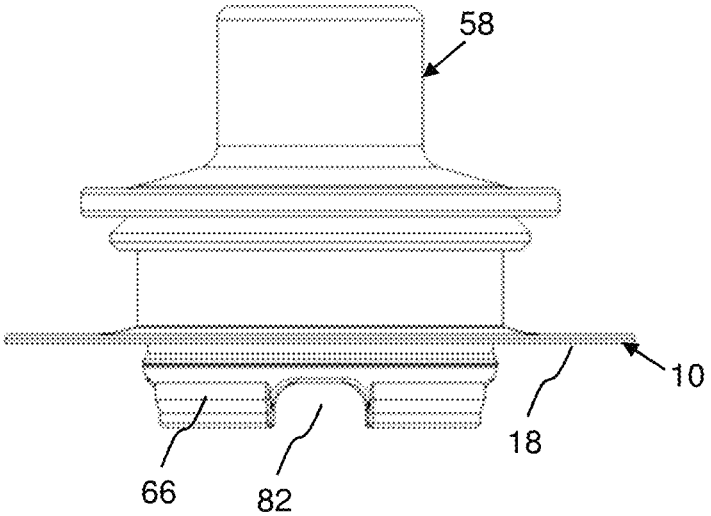
FIG. 14 illustrates a side view of the spout and dispensing member of FIG. 13.
Figure 15:
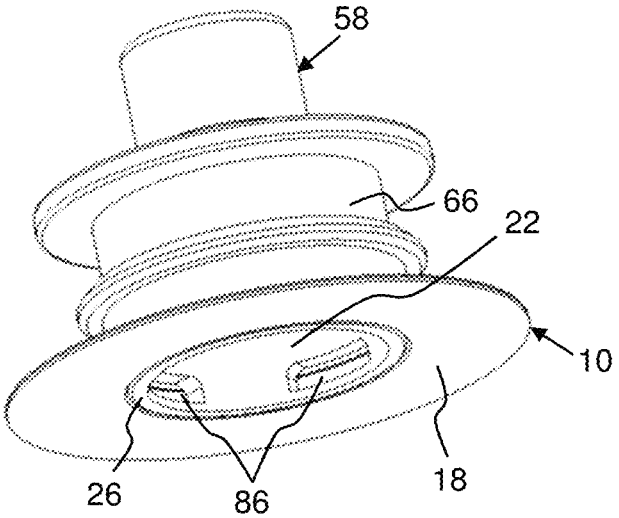
FIG. 15 illustrates a side isometric view of a spout and dispensing member in a first position according to an embodiment of the present technology.
Figure 16:
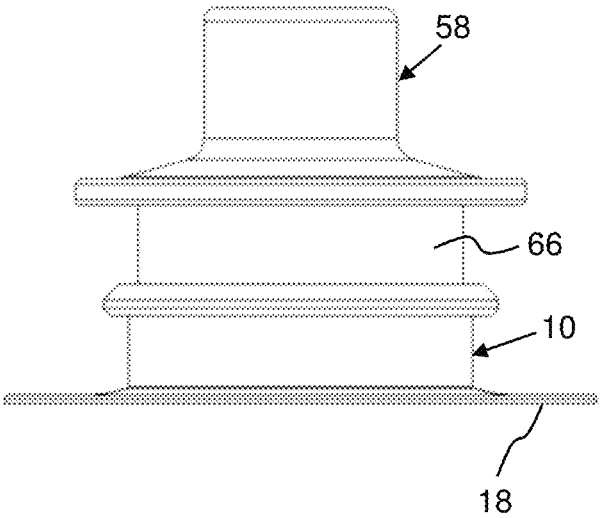
FIG. 16 illustrates a side view of the spout and dispensing member of FIG. 15.

FIGS. 11-14 illustrate an alternative embodiment of the present technology. The spout 10 is generally like the one shown in FIGS. 7 and 8 but does not include the legs 62. The dispensing member 58 is similar to the one shown in FIGS. 7 and 8 but has a series of arched, open apertures or cutouts 82 along the bottom of the first cylindrical body 66. As can be seen in FIGS. 13 and 14, when the dispensing member 58 is in the home position, a lower portion of the first cylindrical body 66 extends below the base 18 of the spout 10. That portion helps prevent the flexible container walls from entering or blocking the spout inlet 26 and passageway 22 during fluid evacuation. The cutouts 82 allow fluid to pass through the first cylindrical body 66 while the body 66 is still preventing blockage. In this way, the first cylindrical body 66 of the embodiment shown in FIGS. 11-14 helps prevent blockage by the flexible walls while at the same time allowing fluid to flow to the spout passageway 22. The number, shape, and size of the cutouts 82 may vary from those shown in FIGS. 11-14. In addition, as an alternative, the dispensing member 58 of FIGS. 11-14 may be used with the spout 10 shown in FIGS. 7-8 or the spout 10 shown in FIGS. 9-10.

Figure 17:
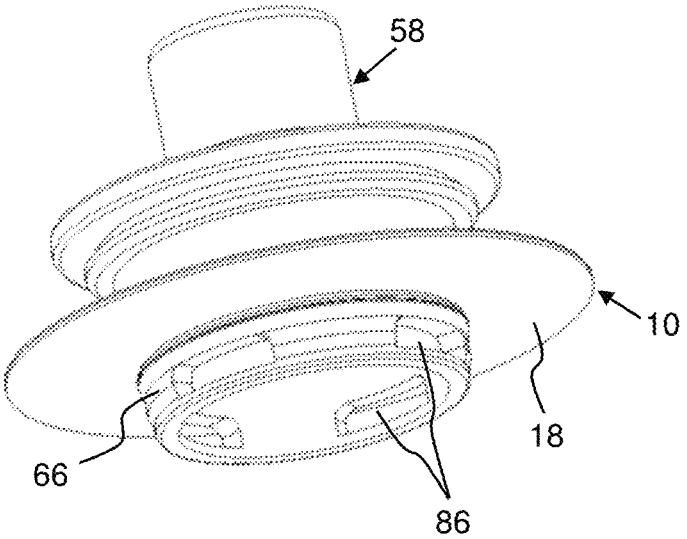
FIG. 17 illustrates a side isometric view of the spout and dispensing member of FIG. 15 in a second position.
Figure 18:
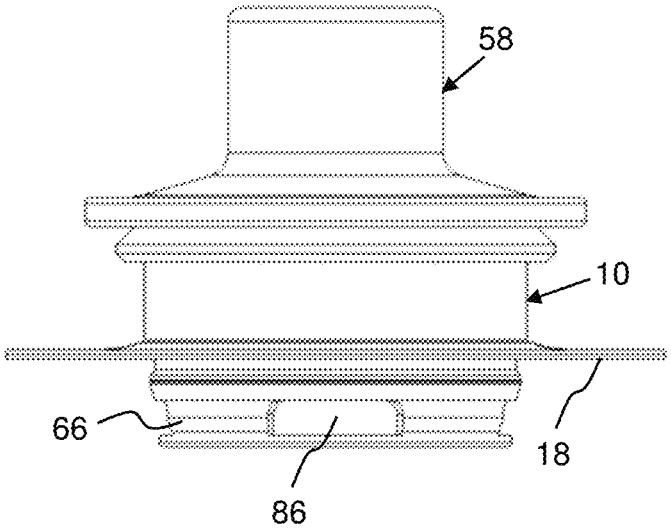
FIG. 18 illustrates a side view of the spout and dispensing member of FIG. 17.

FIGS. 15-18 illustrate an alternative embodiment of the present technology. The spout 10 is generally like the one shown in FIGS. 11-14. The dispensing member 58 is similar to the one shown in FIGS. 7 and 8 but has a series of enclosed slots 86 along the bottom of the first cylindrical body 66. As can be seen in FIGS. 17 and 18, when the dispensing member 58 is in the home position, a lower portion of the first cylindrical body 66 extends below the base 18 of the spout 10. That portion helps prevent the flexible bag walls from entering or blocking the spout inlet 26 and passageway 22 during fluid evacuation. The slots 86 allow fluid to pass through the first cylindrical body 66 while the body 66 is still preventing blockage. In this way, the first cylindrical body 66 of the embodiment shown in FIGS. 15-18 helps prevent blockage by the flexible walls while at the same time allowing fluid to flow to the spout passageway 22. The number, shape, and size of the slots 86 may vary from those shown in FIGS. 15-18. In addition, as an alternative, the dispensing member 58 of FIGS. 15-18 may be used with the spout 10 shown in FIGS. 7-8 or the spout 10 shown in FIGS. 9-10.

FIGS. 19-24 illustrate another alternative embodiment of the present technology that can be used with the container 14 of FIG. 1. The embodiment includes a spout 10, an insertable member or insert 90, and a cap 94. The insert 90 is generally cylindrical has a passageway extending therethrough and is slidably and telescopingly received in the passageway 22 of the spout 10. The insert 90 includes enclosed apertures, cutouts or slots 98 positioned near the bottom thereof. Alternatively, the cutouts 98 may not be enclosed but may be open at the bottom. At its bottom end, the insert 90 includes a circular cage or grill 102 that includes gaps 106. The sizes and shapes of the cutouts 98 and gaps 106 can vary from those shown in FIGS. 19-24. The cap 94 includes inner and outer cylindrical portions 110 and 114 that are separated by an annular channel 118. The inner cylindrical portion 110 is configured to be slidably received in the passageway 22 of the spout 10 while the channel 118 slidably receives a portion of the spout wall 34.

Figure 19:
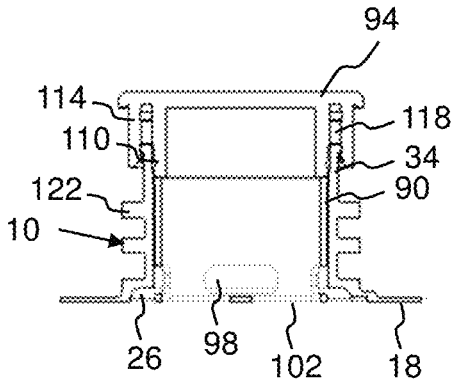
FIG. 19 illustrates a side cutaway view of a spout, insert, and cap in a first position according to an embodiment of the present technology.
Figure 20:
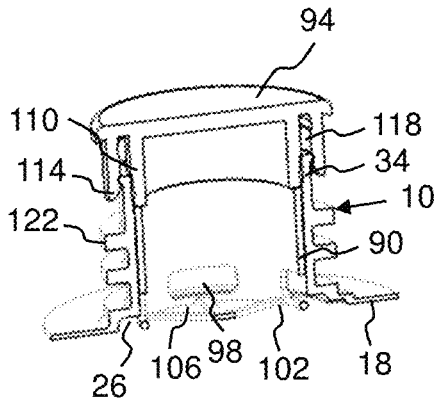
FIG. 20 illustrates an isometric cutaway view of the spout, insert, and cap of FIG. 19.

FIGS. 19 and 20 show the system in a "transit" or first position with the cap 94 partially inserted into the spout 10 and the insert 90 positioned entirely or almost entirely in the passageway 22 of the spout 10. The cap 94 and the insert 90 may be held in the transit position in the spout 10 by, for example, a press fit, or a snappable connection to the spout 10 via, for example, a tab and groove arrangement. In the transit position, the cap 94 and insert 90 are in contact or are close to being in contact with each other in the passageway 22.

Figure 21:
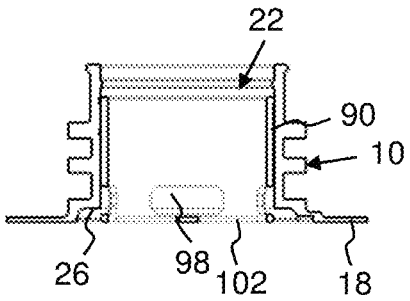
FIG. 21 illustrates a side cutaway view of the spout and insert of FIG. 19.

FIG. 21 shows the cap 94 removed so that the container 14 can be filled with fluid through the spout 10. During that process, the insert 90 may stay in the transit position.

Figure 22:
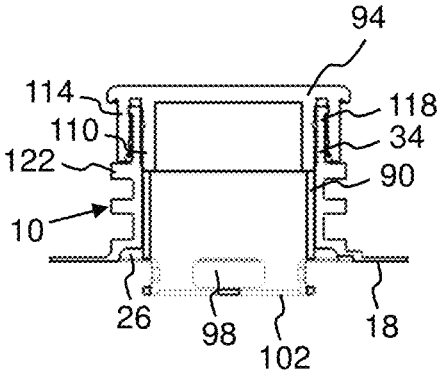
FIG. 22 illustrates a side cutaway view of the spout, insert, and cap of FIG. 19 in a second position.
Figure 23:
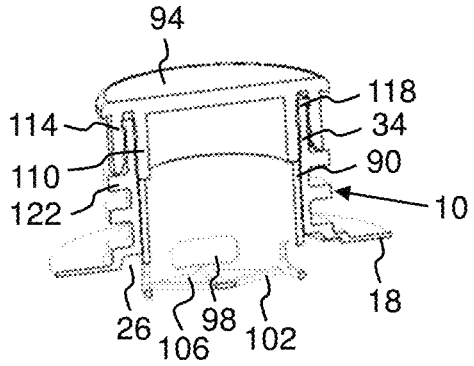
FIG. 23 illustrates an isometric cutaway view of the spout, insert, and cap of FIG. 22.

Once the container 14 is filled with fluid, and as shown in FIGS. 22 and 23, the cap 94 is put back on the spout 10 and moved to a "home" or second position in which the cap 94 is inserted into the spout 10 until the outer cylindrical portion 114 of the cap 94 engages an upper flange 122 on the spout 10. The cap 94 can be held in the home position by, for example, a press fit or a snappable connection with the spout wall 34. When the cap 94 is moved to the "home" or second position, it pushes the insert 90 further downward in the passageway 22 to a "home" position such that the portion of the insert 90 including the cage 102 and cutout 98 is extended below the base 18 of the spout 10.

Figure 24:
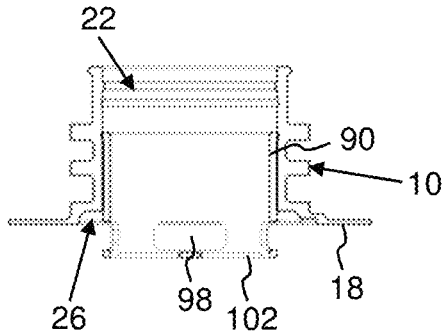
FIG. 24 illustrates a side cutaway view of the spout and insert of FIG. 22.
Figure 25:
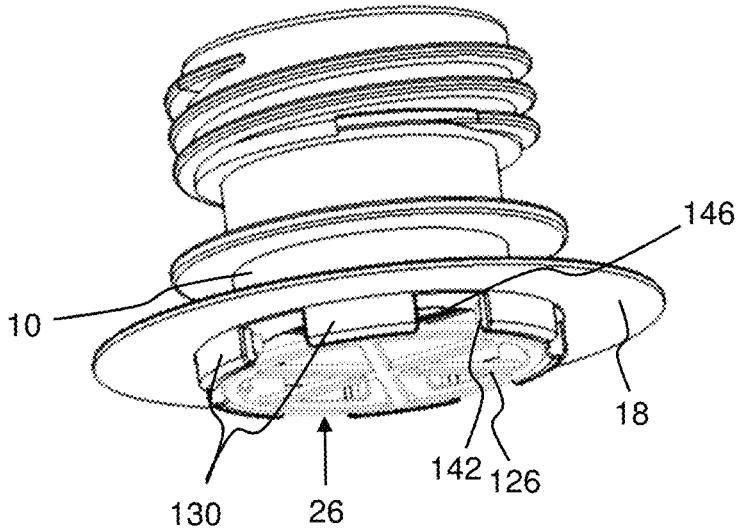
FIG. 25 illustrates a side isometric view of a spout according to an embodiment of the present technology.
Figure 26:
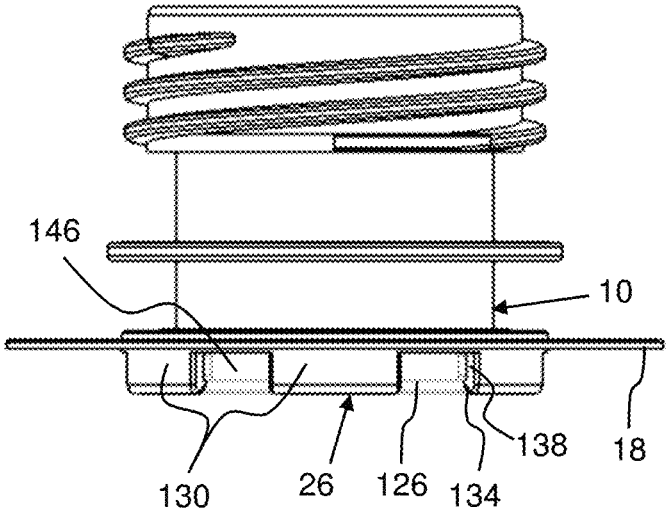
FIG. 26 illustrates a side view of the spout of FIG. 25.
Figure 27:
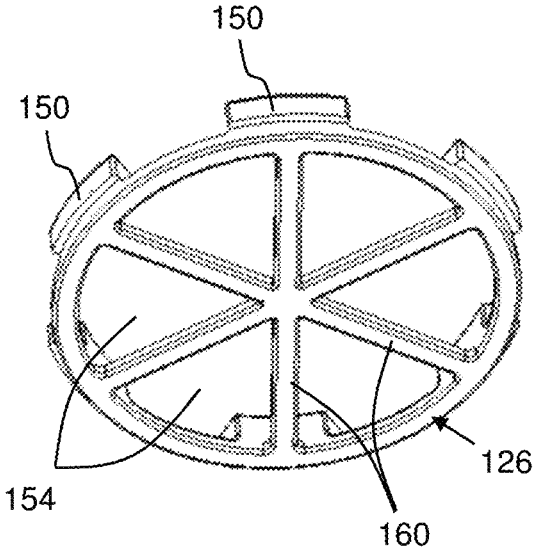
FIG. 27 illustrates a bottom isometric view of a cage that is part of the spout of FIG. 25.
Figure 28:
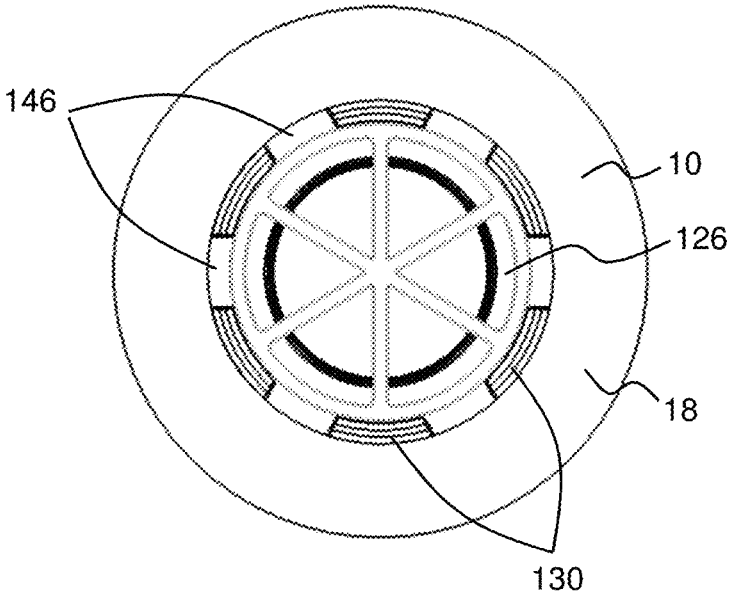
FIG. 28 illustrates a bottom view of the spout of FIG. 25.

With reference to FIG. 24, when it is time to evacuate the fluid contents of the container 14, the cap 94 is removed from the spout 10. The cage 102 and the portion of the insert 90 that extends below the base 18 of the spout 10 help prevent the flexible bag walls from entering or blocking the spout inlet 26 and passageway 22 during fluid evacuation. The cutouts 98 and gaps 106 allow fluid to pass through the passageway of the insert 90 while the cage 102 and the portion of the insert extending below the base 18 help prevent blockage. In this way, the insert 90 helps prevent blockage by the flexible walls while at the same time allowing fluid to evacuate through the insert 90 and spout 10. In an alternative embodiment, the cage 102 may be arced like the cage 38 of FIGS. 1-6.

FIGS. 25-28 illustrate another embodiment of the present technology that can be used with the container 14 of FIG. 1. The embodiment includes a spout 10 and a circular cage or grill 126 that are detachably connected to each other by a bayonet connection system. The spout 10 includes a series of equi-spaced bayonet fittings 130 that extend downwardly from the base 18 and that are radially arranged around the inlet 26. Each fitting 130 includes an L-shaped inwardly extending projection 134 defining a channel 138. An upwardly extending retaining projection 142 is provided on each L-shaped projection 134 to retain items in the channel 138. The fittings 130 are separated by gaps 146. The cage 126 includes a series of radially extending tabs 150, which tabs 150 are of a size to fit between the gaps 146 and within the channels 138. The cage 126 includes bars 160 that define gaps 154. The cage 126 can be connected to the spout 10 by aligning the tabs 150 with the gaps 146 and rotating the cage 126 such that each tab 150 rotates and slides into a respective channel 138 of a fitting 130. The tabs 150 can be snapably locked into place by the retaining projections 142. The cage 126 can be detached from the spout 10 by rotating it the opposite direction to snapably remove the tabs 150 from the channels 138 and into the gaps 146, at which point the cage 126 can be pulled downwardly away from the spout base 18. In alternative embodiments, the cage 126 may be integrally formed with the spout 10 and/or the cage may be arced—and not "flat"—like the cage 38 of FIGS. 1-6. It will be understood that the gaps 154 of the cage 126 may have different sizes and shapes than those shown in FIGS. 25-28. In addition, the cage 126 may alternatively be detachably connected to the spout 10 by different means.

In operation, the cage 126 helps prevent the flexible bag walls from entering or blocking the spout inlet 26 and passageway 22 during fluid evacuation. The gaps 154 allow fluid to pass into the spout 10 while the bars 160 of the cage 126 help prevent blockage.

FIGS. 29-37 illustrate another embodiment of the present technology that can be used with the container 14 of FIG. 1. The embodiment includes a spout 10, a flexible cage 162, and a fitment 164. The flexible cage 162 is generally circular and is installed in the base 18 of the spout 10 within a snap fit groove 166. The flexible cage 162 includes an outer portion 168, an inner portion 170, and flexible arms 172 that connect the outer and inner portions 168 and 170. The flexible arms 172 allow the inner portion 170 to move downward relative to the spout 10 and the outer portion 168. The inner portion 170 includes bottom stand-off protrusions 174 and top stand-off protrusions 176 with corresponding bottom gaps 178 and top gaps 180 between. The outer portion 168 also includes outer stand-off protrusions 182 with corresponding outer gaps 184. The number, sizes, and shapes of the bottom, top, and outer stand off protrusions 174, 176, and 182 as well as the bottom, top, and outer gaps 178, 180, and 184 can vary from those shown in FIGS. 29-36.

Figure 29:
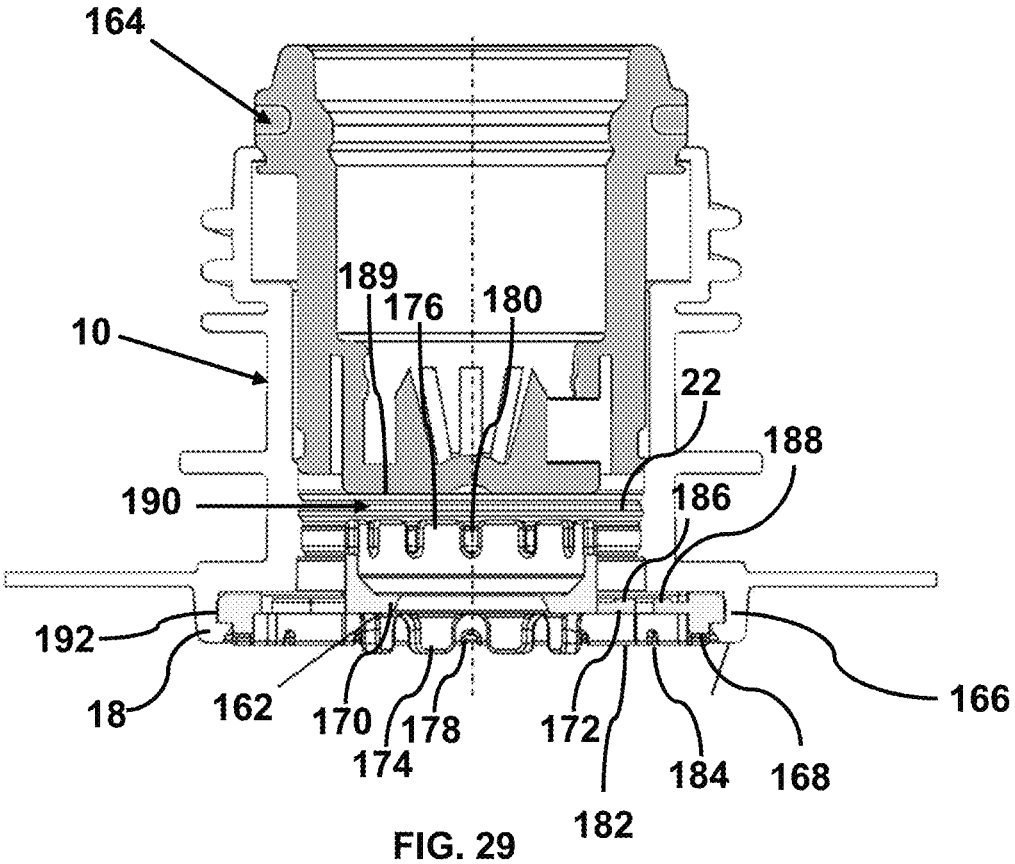
FIG. 29 illustrates a cutaway side view of a spout, a flexible cage, and a fitment according to an embodiment of the present technology with the flexible cage and fitment in a first position.

FIG. 29 shows the fitment 164 and inner portion 170 of the flexible cage 162 in a "transit" or first position within the spout 10. The flexible arms 172 hold the inner portion 170 in the transit position within the spout 10. The flexible arms 172 have an inner segment 186 and an outer segment 188. In the transit position, the bottom stand-off protrusions 174 extend just below the outer stand-off protrusions 182 and the spout base 18. A space 190 exists between the top stand-off protrusions 176 and a bottom surface 189 of the fitment 164 allowing for some upward movement of the inner portion 170 without the top stand-off protrusions 176 contacting the fitment bottom surface 189 while in the transit position. The inner segment 186 of the flexible arms 172 can partially enter the passageway 22 of the spout 10 during this upward movement of the inner portion 170. Once the force pushing the inner portion 170 is removed, the flexible arms 172 return the inner portion 170 to the transit position. The spout base 18 retains a flange 192 of the outer portion 168 within the snap fit groove 166 using a snap fit type connection. In other embodiments, a press fit connection or other similar method may be used to secure the outer portion 168 within the spout base 18.

Figure 30:
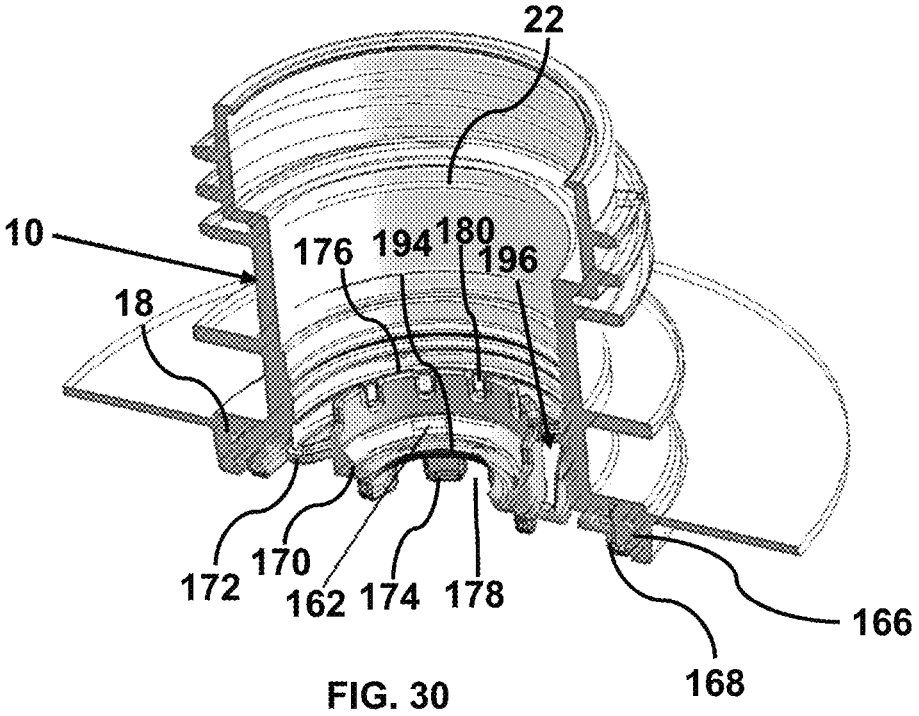
FIG. 30 illustrates an isometric cutaway view of the spout and flexible cage of FIG. 29.
Figure 31:
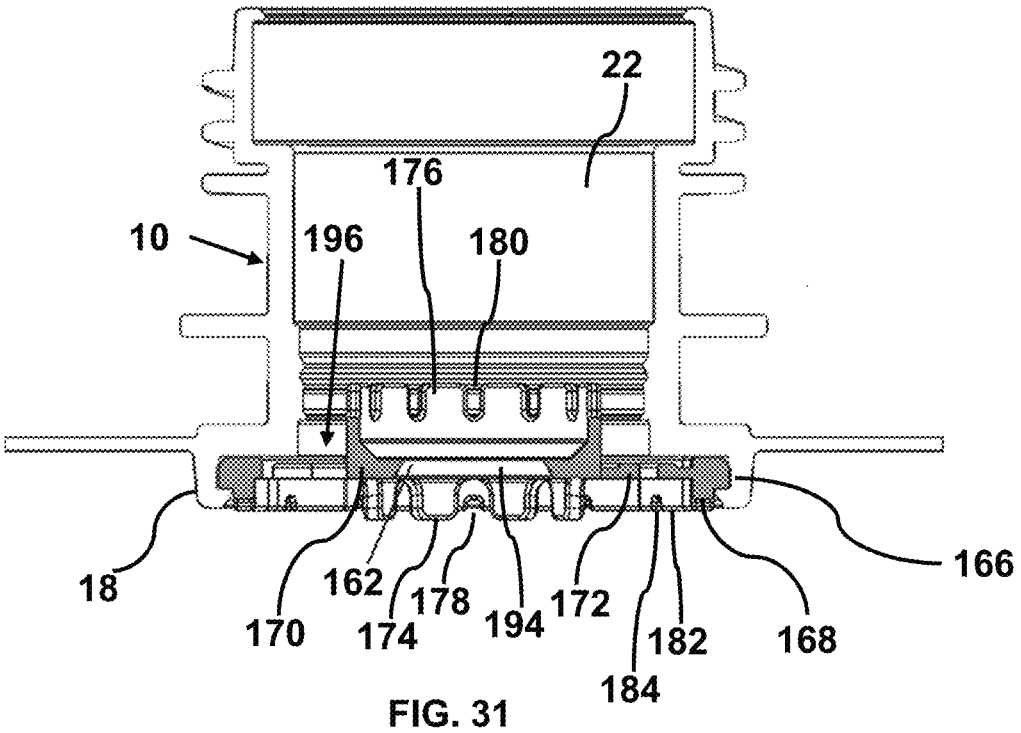
FIG. 31 illustrates a cutaway view of the spout and flexible cage of FIG. 29.

FIGS. 30 and 31 show the spout 10 and flexible cage 162 with the fitment 164 removed from the spout 10 to allow the container 14 to be filled with fluid through the spout 10. Before the filling process begins, the flexible arms 172 hold the inner portion 170 in the transit position of FIG. 29. During the filling process, fluid enters the spout passageway 22, flows past the flexible cage 162, and into the container 14. During the filling process, the fluid flows through a central bore 194 of the inner portion 170. The filling process also provides a downward force on the flexible cage inner portion 170 resulting in the inner portion 170 and flexible arms 172 deflecting downward. This deflection further increases the size of an opening 196 between the outer portion 168 and inner portion 170 and fluid can flow through that opening 196. The deflection and expanded opening 196 may reduce the turbulence and aeration of the fluid flowing into the container as well as may reduce splashing of the liquid out of the container. Once the filling is complete, the downward force from the fluid flowing through the spout 10 is removed from the inner portion 170 of the flexible cage 162, allowing the flexible arms 172 to return the flexible cage inner portion 170 to the transit position.

Figure 32:
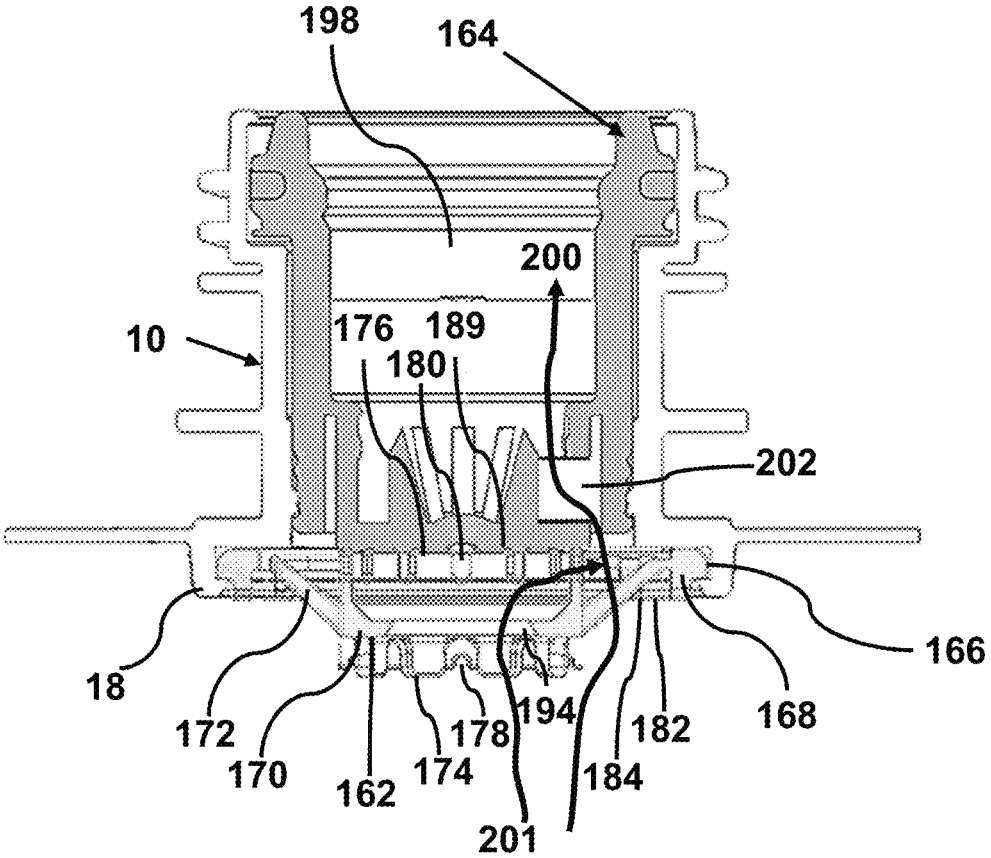
FIG. 32 illustrates cutaway view of the spout, flexible cage, and fitment of FIG. 29 in a second position.

FIG. 32 shows the fitment 164 fully inserted into the spout 10 to a "home" or second position. A plug or cap (not shown) may be used to cover and/or seal a fitment inner cavity 198. The plug allows the fitment 164 to seal the container 14 after the container 14 is filled with fluid. The fitment bottom surface 189 pushes the top stand-off protrusions 176 of the inner portion 170 downward, moving the entire inner portion 170 downward as well. The bottom stand-off protrusions 174 move downward to a point where they extend fully below the outer stand-off protrusions 182 and the spout base 18. The flexible arms 172 keep the top stand-off protrusions 176 engaged against the fitment bottom surface 189 while also helping keep the inner portion 170 centered relative to the passageway 22 of the spout 10.

Once the container 14 is at the location for use, the plug is removed from the fitment 164, and the dispensing connector (not shown) that is connector to a pump or other device that creates a vacuum is inserted into the fitment inner cavity 198 in order to suck the fluid from the container 14. Once connected, the dispensing connector creates a flow path 200 from the container 14, past the flexible cage 162, past a through hole 202 of the fitment 164, and into the dispensing connector and into a tube or line connected to the dispensing connector to a final dispensing device. For the fitment 164 as shown, the flow path 200 may include going past the flexible cage 162 through the opening 196 between the outer and inner portions 168 and 170 of the flexible cage 162. As the fluid in the container 14 is evacuated, the bottom stand-off protrusions 174, outer stand-off protrusions 182, and the flexible arms 172 prevent the flexible bag walls of the container 14 from entering, blocking, or sealing off the spout 10. As the flexible bag walls collapse, a secondary flow path 201 allows fluid to flow between the bottom stand-off protrusions 174 and through the bottom gaps 178, through the central bore 194, between the top stand-off protrusions 176 and through the top gaps 180 before joining the main flow path 200 as the main flow path 200 goes through the through hole 202 of the fitment 164. The outer gaps 184 between the outer stand-off protrusions 174 further prevent the flexible bag walls from creating a seal against the spout base 18.

In other embodiments, alternative fitments (not shown) may have the through hole located in the bottom surface 189 of the fitment 164. In those embodiments, an alternate first flow path would be between the bottom stand-off protrusions 174 and through the bottom gaps 178, through the central bore 194, and through the alternative through hole. The alternate secondary flow path would be through the opening 196 between the outer and inner portions 168 and 170 of the flexible cage 162, between the top stand-off protrusions 176 and through the top gaps 180 before joining the alternative first flow path through the alternative through hole. Similarly, in some embodiments, the fitment 164 may be omitted, and a dispenser connector may directly be inserted into the spout 10 in place of the fitment 164 shown of FIGS. 29-32. In these embodiments, the dispenser may contact the top stand-off protrusions 176 and place the flexible cage 162 in the home position.

Figure 33:
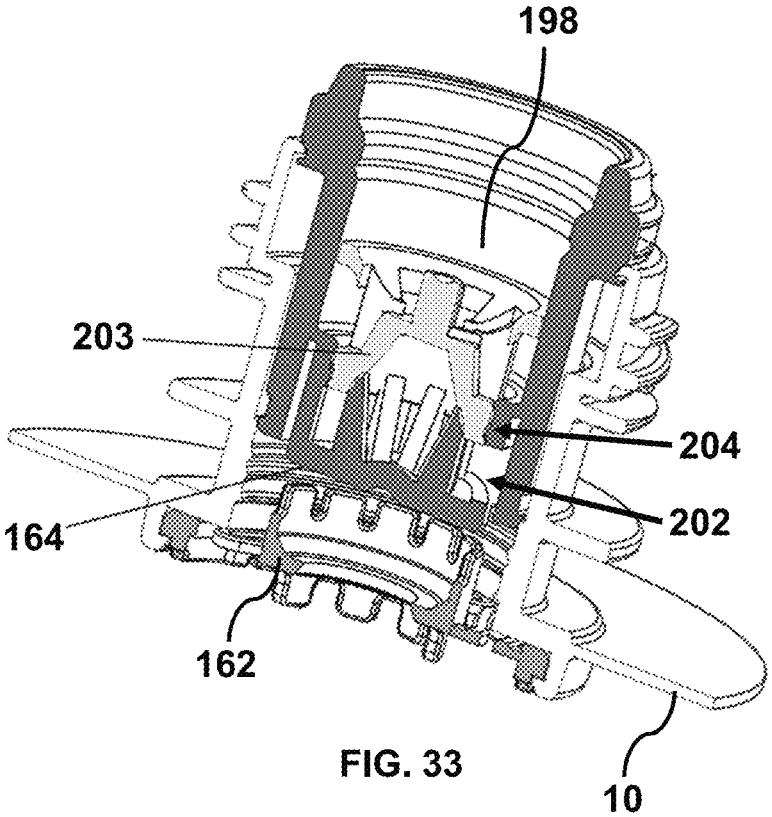
FIG. 33 illustrates a perspective view of the spout and flexible cage of FIG. 29 with a fitment and a slidable insert in the closed position.

FIG. 33 shows the spout 10 and flexible cage 162 of FIG. 29 along with an example slidable valve 203 inserted into the fitment 164 in a closed position. In the closed position, the slidable valve 203 creates a seal 204 against the fitment 164 isolating the through hole 202 and preventing fluid from flowing from the container 14 to the fitment inner cavity 198, replacing the need for a separate plug as described above. Once the container 14 is at the location for use, the dispensing connector (not shown) is inserted into the fitment inner cavity 198 in order to suck the fluid from the container 14. As the dispensing connecter enters the fitment inner cavity 198, the dispensing connector pushes the slidable valve 203 downward into an open position (not shown). In the open position, slidable valve 203 moves downward into the bottom of the fitment 164 thereby breaking the seal 204 between the fitment 164 and slidable valve 203. This allows the fluid to flow past the through hole 202, through the slidable valve 203, into the fitment inner cavity 198, and into the dispensing connector. Similarly, other fitment designs with alternative slidable valves could be adopted to use the spout 10 and flexible cage 162 of FIGS. 29-32.

Figure 34:
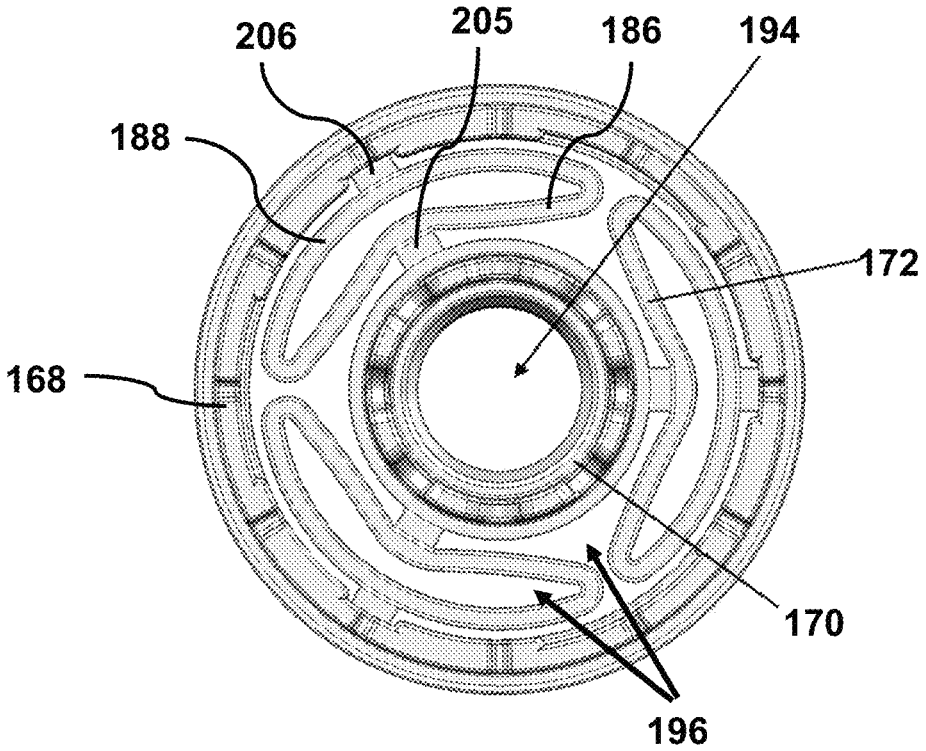
FIG. 34 illustrates a bottom view of the flexible cage of FIG. 29.
Figure 35:
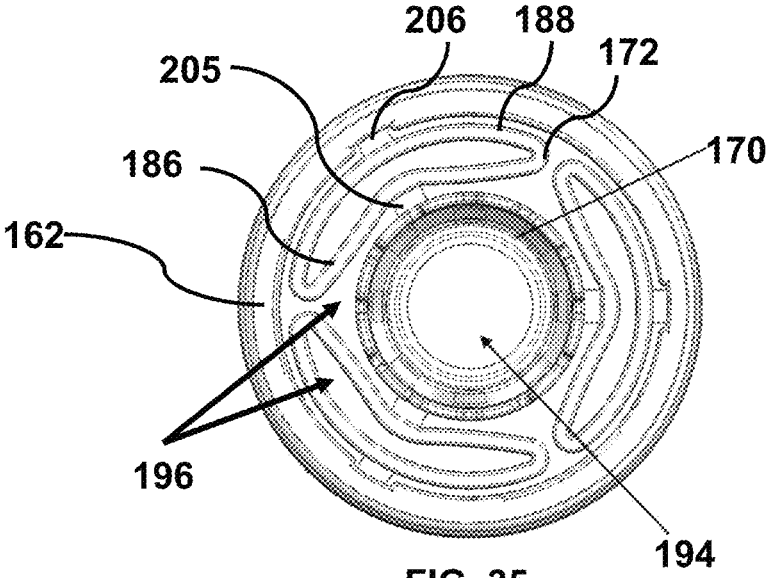
FIG. 35 illustrates a top view of the flexible cage of FIG. 29.
Figure 36:
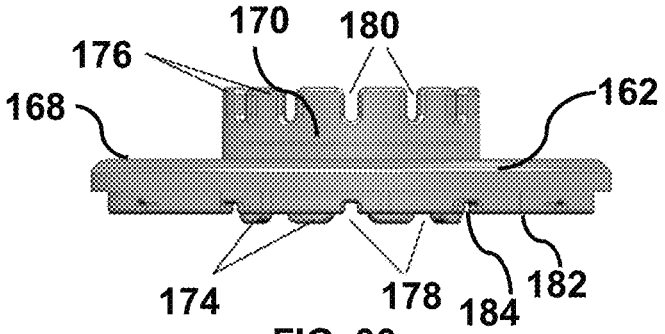
FIG. 36 illustrates a side view of the flexible cage of FIG. 29.
Figure 37:
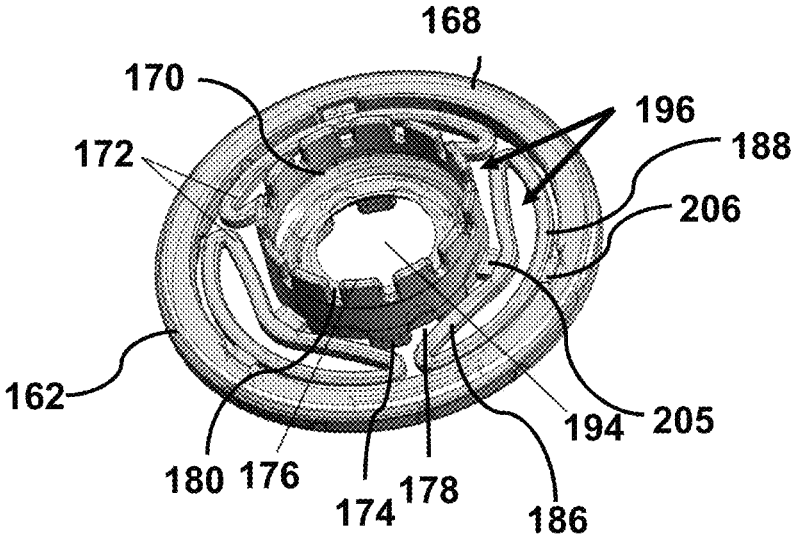
FIG. 37 illustrates an isometric view of the flexible cage of FIG. 29.

FIGS. 34-37 show various perspectives of the flexible cage 162 of FIGS. 29-32. FIG. 34 is a bottom view of the flexible cage 162. FIG. 35 is a top view of the flexible cage 162. FIG. 36 is a side view of the flexible cage 162. FIG. 37 is an upper perspective view of the flexible cage 162. As described above, the outer portion 168 is connected to the inner portion 170 by the flexible arms 172. The flexible arms 172 include inner segments 186 and outer segments 188. The flexible arms 172 may further include an inner tab 205 to connect the inner segment 186 to the inner portion 170 and an outer tab 206 to connect the outer segment 188 to the outer portion 168 of the flexible cage 162. The inner segments 186 and outer segments 188 extend from two sides of the inner tab 205 and outer tab 206 respectively. The opening 196 for the fluid flow path 200 between the outer portion 168 and inner portion 170 of the flexible cage 162 includes both the area between the inner segments 186 and outer segments 188 of a given set of flexible arms 172 as well as the area between the individual sets of flexible arms 172. The present embodiment has three sets of flexible arms 172. Other embodiments could include additional segments of the flexible arms 172, could extend from only a single side of the inner tab 205 and outer tab 206, could omit the inner tab 205 and outer tab 206, and/or could have a different number of sets of flexible arms and/or flexible arms having different shapes.

The flexible cage has eight bottom stand-off protrusions 174, twelve top stand-off protrusions 176, and twelve outer stand-off protrusions 182 along with the same number of bottom, top, and outer gaps 178, 180, and 184. Other embodiments may adjust the size, shape, and number of the stand-off protrusions and corresponding gaps based on the needs of the systems. In yet other embodiments, the top stand-off protrusions may be omitted based on the corresponding fitment or connector creating the required gaps, or the outer stand-off protrusion may be omitted such as in instances when the associated spout has stand-off features. The bottom stand-off protrusions 174 and top stand-off protrusions 176 surround the central bore 194 of the inner portion 170.

Figure 38:
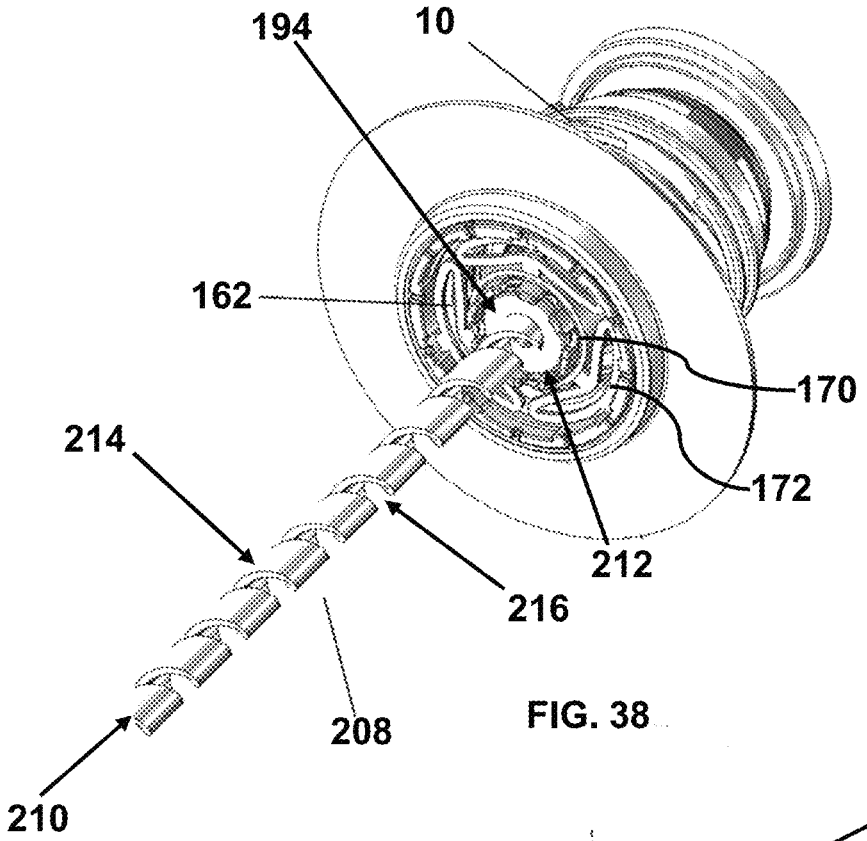
FIG. 38 illustrates an isometric view of the spout and flexible cage of FIG. 29 with an evacuation member installed into the flexible cage.
Figure 39:
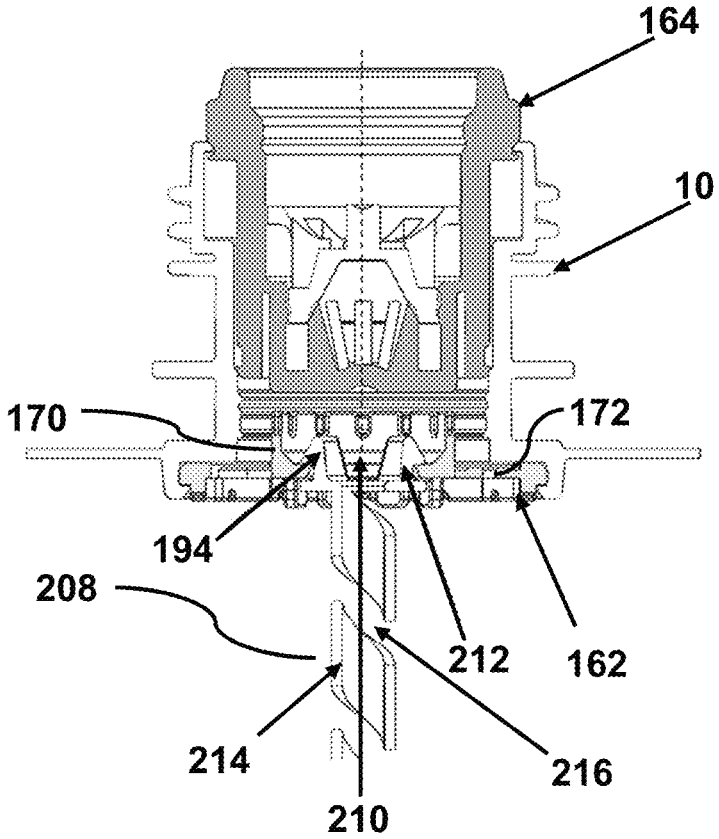
FIG. 39 illustrates a cutaway side view of the spout, flexible cage, and fitment of FIG. 29 with the evacuation member installed into the flexible cage.

FIGS. 38 and 39 show the spout 10, flexible cage 162, and fitment 164 of FIGS. 29-32 with an evacuation member 208 inserted into the central bore 194 of the flexible cage 162. The evacuation member 208 extends into the container 14 and provides a duct 210 that facilitates the extraction of fluid from within the flexible walls of the container 14 to the spout 10. The evacuation member 208 has a head 212 that is inserted into the central bore 194 of the flexible cage 162 using a snap fit or equivalent connection. The evacuation member 208 also includes a body 214. In the present example, the body 214 has a helical shape. The helical shape of the body 214 results in a helical shaped space 216 between the material of the body 214. In other examples, alternate body shapes may be used such as an elongated tube including a plurality of apertures along the length of the tube, or the body could be made of a tubular netting such as Vexar®. The length of the body 214 can vary based on the size and length of the container.

The operation of the flexible cage 162 of FIGS. 38 and 39 is similar to that described with the flexible cage of FIGS. 29-36 above. However, once the dispensing connector begins to suck the fluid from the container 14 and as the flexible bag walls begin to collapse, the body 212 of the evacuation member 208 provides the duct 210 for fluid further into the container (and/or in hard to reach pockets in the container) to reach the spout 10. The fluid enters within the body spaces 216 while the body 214 prevents the collapse and sealing of the duct as the flexible container walls collapse around the body 214. The inner portion 170 and flexible arms 172 of the flexible cage 162 may deflect further based on the forces applied by the flexible container walls onto the evacuation member body 214. The flexible arms 172 will resist those forces and maintain the inner portion 170 near the same location, allowing the inner portion 170 and flexible arms 172 along with the evacuation member body 212 to prevent the sealing of the spout 10 by container walls and/or the entry of the container walls into the spout 10.

The spouts and fitments shown in the Figures are examples, and different types of spouts and fitments can be used with the blockage prevention technology disclosed herein.

The embodiments of the present technology provide evacuation structures that help prevent the walls of the flexible container or bag from entering the inlet and/or passageway of the spout during evacuation. The structures do this while allowing fluid to flow into or out of the container. The present technology disclosed herein can be used in conjunction with bags that include a textured or embossed film on the inside of the flexible containers, such as the bags disclosed in U.S. Pat. No. 6,984,278, which is incorporated herein by reference.

The embodiments disclosed herein are not limited to the specific polymers or materials discussed with respect to those embodiments. Any number of different kinds of polymers having different properties can be used with the embodiments disclosed herein.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A system for evacuating fluid from a flexible container, comprising:

a spout having a base that is configured to be connected to one of a plurality of walls of the flexible container and a passageway in fluid communication with an interior region of the flexible container, the passageway having an outlet at a top end and an inlet at a bottom end; and a flexible cage positioned proximate the bottom end of the passageway and including:

an outer portion, the outer portion secured in the base of the spout;

an inner portion, the inner portion comprising a top surface, a bottom surface, and a central bore extending between the top surface and the bottom surface, the top surface including a plurality of top protrusions with a plurality of top gaps between the top protrusions, the bottom surface including a plurality of bottom protrusions with a plurality of bottom gaps between the bottom protrusions; and a plurality of flexible arms, the flexible arms connecting the inner and outer portions;

wherein:

the flexible cage having a first position wherein the flexible arms are deflected and the bottom protrusions extend a first distance below the spout base to be positioned to block a portion of one of the plurality of walls of the flexible container from entering the inlet of the passageway and preventing fluid from evacuating the container via the passageway; and the flexible cage having a second position wherein the flexible arms are not deflected and the bottom protrusions are closer to the spout base than they are when cage is in the first position.

2. The system of claim 1, wherein the outer portion further comprises a plurality of outer protrusions with a plurality of gaps between the outer protrusions, the outer protrusions extending below the base of the spout.

3. The system of claim 1, wherein the system further comprises an evacuation member, the evacuation member comprising a head and a body, the head configured to be inserted into the central bore and the body configured to extend into the container, the head and body forming a duct from within the container to the flexible cage.

* * * * *